US006293841B1

(12) United States Patent
Safilian

(10) Patent No.: US 6,293,841 B1
(45) Date of Patent: Sep. 25, 2001

(54) FOLDABLE UNDER WATER VIEWING WINDOW

(76) Inventor: Steven Safilian, 3000 S. Ocean Blvd., Apt. 506, Boca Raton, FL (US) 33432

( * ) Notice: Subject to any disclaimer, the term of this patent is extended or adjusted under 35 U.S.C. 154(b) by 0 days.

(21) Appl. No.: 09/537,383

(22) Filed: Mar. 29, 2000

(51) Int. Cl.[7] ..... B63C 11/00
(52) U.S. Cl. ..... 441/135; 359/895
(58) Field of Search ..... 441/135, 436; 351/43; 359/895

(56) References Cited

U.S. PATENT DOCUMENTS

| | | | |
|---|---|---|---|
| D. 367,307 | 2/1996 | O'Neill | D21/237 |
| 4,145,783 | 3/1979 | Rhodes | 9/310 H |
| 4,228,751 | 10/1980 | Robertson et al. | 114/66 |
| 4,465,468 | 8/1984 | Deacy | 441/135 |
| 4,553,819 | 11/1985 | Correll | 350/319 |
| 4,691,658 | 9/1987 | New et al. | 114/66 |
| 4,715,837 | 12/1987 | Floyd | 441/135 |
| 4,895,539 | 1/1990 | Bender | 441/135 |
| 4,925,417 | 5/1990 | Warren | 441/65 |
| 5,145,431 | 9/1992 | Dowdeswell | 441/135 |
| 5,447,459 | 9/1995 | Hammond | 441/135 |
| 5,599,220 | 2/1997 | Smith | 441/135 |
| 5,672,082 | 9/1997 | Binder | 441/135 |

*Primary Examiner*—Jesus D. Sotelo
(74) *Attorney, Agent, or Firm*—John C. Smith

(57) ABSTRACT

A floating window for viewing underwater life, which has an unfolded viewing configuration and a folded storage configuration for transport and/or storage. Floating end walls are attached to a central viewing window and have sufficient buoyancy to prevent the device from sinking beneath the surface. The central window is secured on either end to a floating end wall. The central window is flexible and curve upward on the edges extending between the floating end walls such that a cavity is formed with a central viewing area. The central window is attached to the floating end walls such that the central viewing area is held below the surface of the water and the edges of the central window extend above the surface of the water to prevent water from spilling onto the top surface of the central viewing area. The central window is secured to slots on the inside surface of each floating end wall by a pressure fit. In the storage configuration, the floating end walls are removed from the central window, placed adjacent one another, and secured together by wrapping the flexible central window around the floating end walls and securing it with an elastic strap.

19 Claims, 7 Drawing Sheets

FOLDABLE UNDER WATER VIEWING WINDOW

BACKGROUND OF THE INVENTION

1. Technical Field

The present invention relates to underwater viewing devices. In particular, it relates to collapsible floating windows which provide an unobstructed underwater view to an individual looking into the water from above the surface of the water.

2. Background Art

For many people, one of the most popular leisure activities is visiting aquatic areas, such as the beach, or lakes. One of the more enjoyable aspects of visiting a lake or the beach is the ability to view underwater life and objects. For example, many individuals enjoy viewing the underwater plant life and underwater creatures, such as fish, shellfish, turtles, etc. Unfortunately, many individuals do not enjoy having their eyes exposed to water due to salt content in ocean water or potentially to contaminants in either ocean water or lake water. In addition, some people are afraid to swim underwater. While it is possible to view some underwater activity from above the surface, the surface tends to refract light such that it is difficult to clearly see what is under the surface. It would be desirable to be able to clearly view underwater activity from above the surface of the water without having to submerge or having to have the individual's eyes come in contact with the water.

One method of viewing the underwater environment is to use a face mask which is strapped onto the swimmer's head. This allows a swimmer to submerge while keeping the swimmers eyes dry. Unfortunately, face masks do not help the individual who does not wish to submerge.

Another alternative approach has been to construct floating windows in which the bottom surface of the window is held below the surface water. These devices eliminate the distortion created by the surface of the water and allow an individual clearly see what is beneath the water. Some variations of this type of device include magnifying glasses, lights, storage pockets, etc. A disadvantage associated with this type of device is that they typically are fairly heavy devices which are difficult to store and transport. The difficulty arises from the fact that they are typically made from rigid materials which are heavy and cannot be folded into a compact storage position when the individual is not at the beach or lake. This is an especially negative aspect when the individual is transporting the device in a vehicle, such as a car or boat, which has limited storage space. Also, these fixed rigid devices tend to be expensive. It would be desirable to have a low cost device capable of being folded into a compact storage configuration for transport to and from an aquatic recreation area and which can be stored in a minimal amount of space.

While addressing the basic desirability of using windows to view underwater aquatic life, the prior art has failed to provide a window which is inexpensive to manufacture, has a minimum number of components, and can be folded into the storage configuration which uses a minimal amount of space.

SUMMARY OF THE INVENTION

The present invention solves the foregoing problems by providing a floating window for viewing underwater life, which has an unfolded viewing configuration and a folded storage configuration for transport and/or storage. The device uses floating end walls which secure to the edge of a flexible central window. The floating end walls have sufficient buoyancy to prevent the device from sinking beneath the surface. The central window is secured on one end to a first floating end wall and secured on the other end to a second floating end wall. The central window is flexible to allow it to curve upward on the edges which extend between the floating end walls such that a cavity is formed with a central viewing area The central window is attached to the floating end walls such that the central viewing area is held below the surface of the water and the edges of the central window extend above the surface of the water to prevent water from spilling onto the top surface of the central viewing area. The central window is secured to the floating end walls by a pressure fit when the central window is secured into slots on the inside surface of each floating end wall. In the storage configuration, the floating end walls are removed from the central window, the floating end walls are placed adjacent one another, and the flexible central window is then wrapped around the floating end walls and secured with an elastic strap.

DESCIPTION OF THE PREFERRED EMBODIMENT

Figure 1:
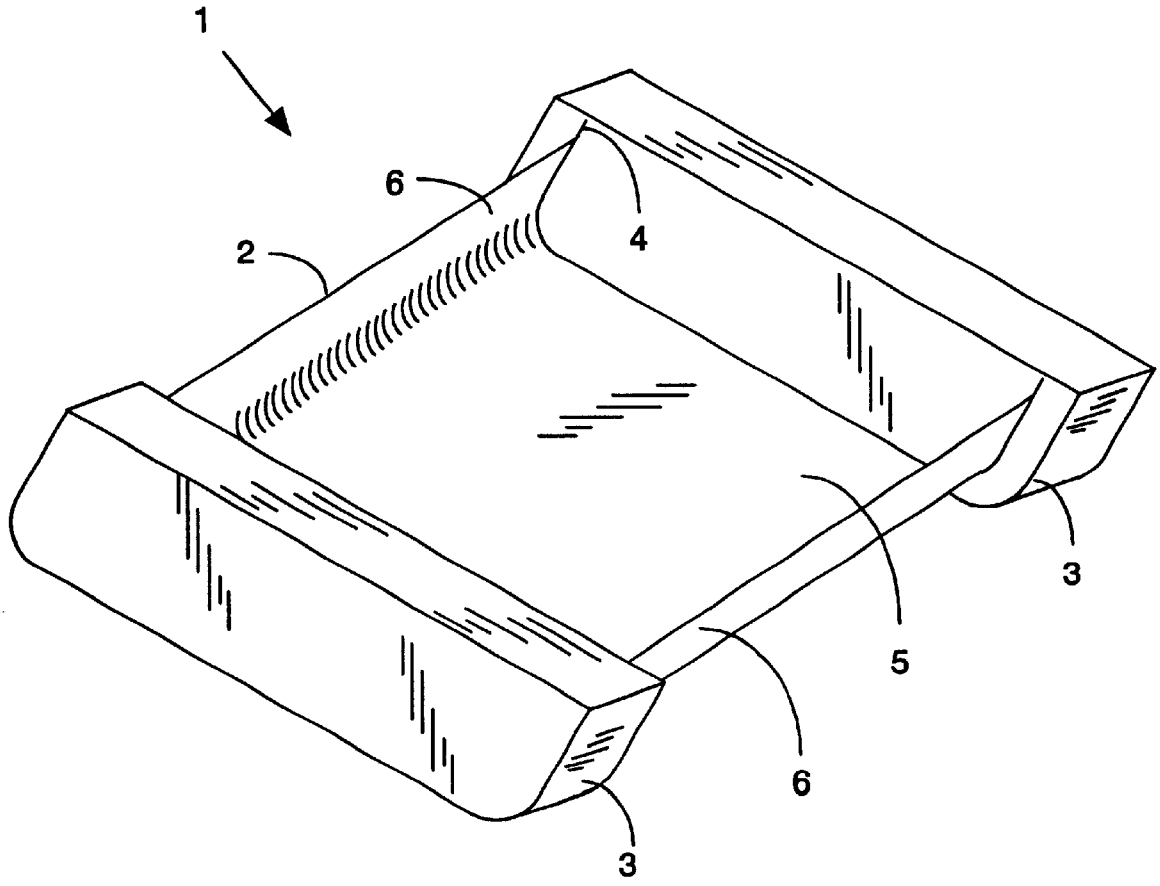
FIG. 1 is a perspective view of a preferred embodiment of the invention which illustrates the viewing window attached to the two floating end walls. This view shows the invention in the non-collapsed configuration.

Referring to FIG. 1, this figure shows a perspective view of a preferred embodiment of the foldable underwater viewing window 1. In this view, two floating end walls 3 per shown attached to a central viewing window 2. The central viewing window 2 is further comprised of a central viewing area 5 and two end walls 6.

In the preferred embodiment, the central viewing window 2 is secured each floating end wall 3 by insertion of the edge of the central viewing window 2 into slots 4 in the sides of the floating end walls 3. In the preferred embodiment, the floating end walls 3 can be made from any material which is buoyant and which will allow the flexible central viewing window 2 to be inserted into the slot 4 in the held in place by a pressure fit. Also, in the preferred embodiment, the material used to construct the floating end walls 3 should be preferably resilient to allow pressure fit to be maintained after numerous insertions and removals of the central viewing window 2. Of course, the material used to fabricate the floating end walls 3 must be resistant to water.

Those skilled in the art will recognize that while pressure fit provided by slot 4 can secure the central viewing window 2 to the floating end walls 3, other methods of attaching the central viewing window 2 to the floating end walls 3 can be used. For example, an adhesive can be used in place of pressure fit provided by slot 4. However, pressure fit is preferred since it is more convenient than adhesive, it is less costly, and it is less likely to result in damage to the floating end walls 3 or the central window 2. Likewise, it is possible to design the foldable underwater viewing window 1 in different configurations. For example, a single unshaped floating end wall can be attached to a central viewing window 2 which has only one side wall 6.

The central window 2 can also be fabricated from any suitable material which is flexible and transparent, such as polypropylene, polyethylene, plastic, etc. Likewise, it must also be resistant to water.

The floating end walls 3 provide several functions for the foldable underwater viewing window 1. First, they provide buoyancy which prevents the device from sinking should the user inadvertently let go of it. Also, while not necessary to implement the invention, the floating end walls 3 should preferably also have sufficient weight to keep the central viewing area 5 below the surface of water when the foldable underwater viewing window 1 is not held by the user, thereby allowing hands free operation. Those skilled in the art will recognize that it is also possible to have the foldable underwater viewing window 1 floating high enough such that a user would have to manually hold it down to keep the central viewing area 5 below the surface of the water.

By the central viewing area 5 is below the surface of the water, visibility problems caused by refraction on the surface of water will be eliminated. As a result, the user has a clear view of activities below the surface of the water and can clearly see the various plant and animal life below the surface without having to expose the user's eyes to the water or to submerge. Because of this, users who were heretofore unable to enjoy viewing underwater life now have unobstructed visibility.

Also shown in this figure are side walls 6 which are designed to extend upward above the surface of the water. As a result, visibility improves because water is prevented from spilling into the central viewing area 5 of a foldable underwater viewing window 1 when it is floating on the surface of the water.

For ease of discussion, the foldable underwater viewing window 1 is shown in a generally rectangular shape. Likewise, the floating end walls 3 are also shown having a particular shape with a curved bottom. Those skilled in the art will recognize that the shape of the floating end walls 3 can be any suitable shape so long as they provide sufficient buoyancy. The central window 2 is also shown inserted into a slot 4 which extends to the upper surface of the floating end walls 3. Of course, the slot 4 only needs to be sufficiently long enough to accommodate insertion of the central viewing window 2 and may or may not extend to the upper surface of the floating end walls 3.

The central window 2, when secured to the floating end walls 3 by insertion into slot 4, should be secured snugly enough to prevent entry of water around slot 4. This is important to prevent accumulation of water inside central viewing area 5.

Figure 2A:
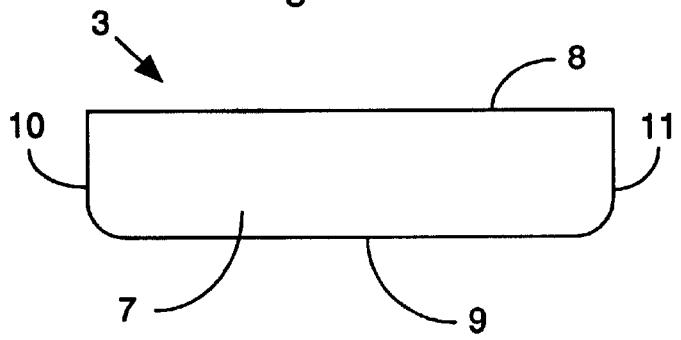
FIG. 2A is a side view of the preferred embodiment of FIG. 1 which shows the outer side wall of a floating end wall.

In FIG. 2A, an outer side view of the floating end wall 3 in the embodiment of FIG. 1 is shown. In this figure, outer surface 7 of floating end wall 3 is shown. In addition, end surfaces 10 and 11, upper surface 8, and lower surface 9 are shown. As noted above, a particular shape of the floating end wall 3 is not important so long as it provides buoyancy, and the ability to snugly secure itself to the edge of central window 2.

Figure 2B:
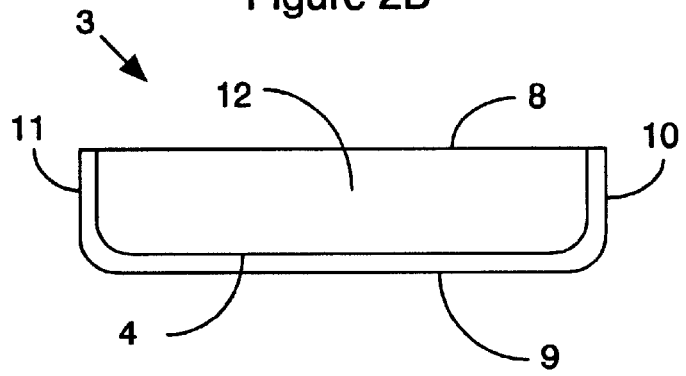
FIG. 2B is a side view of the preferred embodiment of FIG. 1 which shows the inner side wall of a floating end wall. Also shown in this figure is the retaining slot for the central window.

In FIG. 2B, an inner side view of the floating end wall 3 in the embodiment of FIG. 1 is shown. This figure illustrates the location of the slot 4 on the inner side surface 12 of floating end wall 3. The precise location of slot 4 is not critical. It must be offset from end surfaces 10, 11 by a distance sufficient to provide a secure mechanical hold when the central window 2 is pressure fit into slot 4.

Figure 2C:
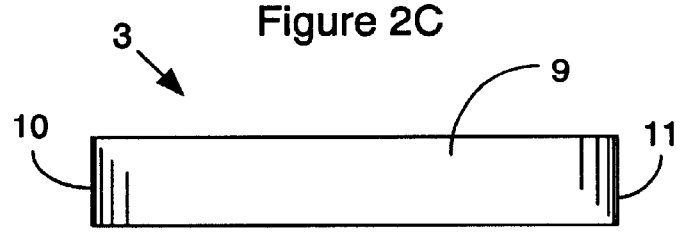
FIG. 2C is a bottom view of the preferred embodiment of FIG. 1 which shows the bottom surface of a floating end wall.

In FIG. 2C, a bottom view of floating end wall 3 is shown. FIG. 2C illustrates the bottom surface as curving upward toward end surfaces 10, 11. However, as noted above, the particular shape used to implement the floating end wall 3 is not critical.

Figure 2D:
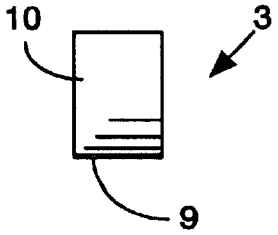
FIG. 2D is an end view of the preferred embodiment of FIG. 1 which shows the first end surface of a floating end wall.

In FIG. 2D, an end view of floating end wall 3 is shown. This figure illustrates the lower portion of end wall 10 curving to meet bottom surface 9.

Figure 2E:
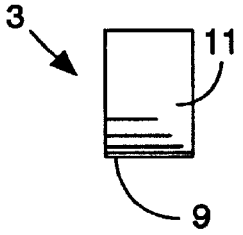
FIG. 2E is an end view of the preferred embodiment of FIG. 1 which shows the second end surface of a floating end wall.

In FIG. 2E, an end view of the opposite end of floating end wall 3 is shown. This figure illustrates the lower portion of end wall 11 curving to meet bottom surface 9.

Figure 3:
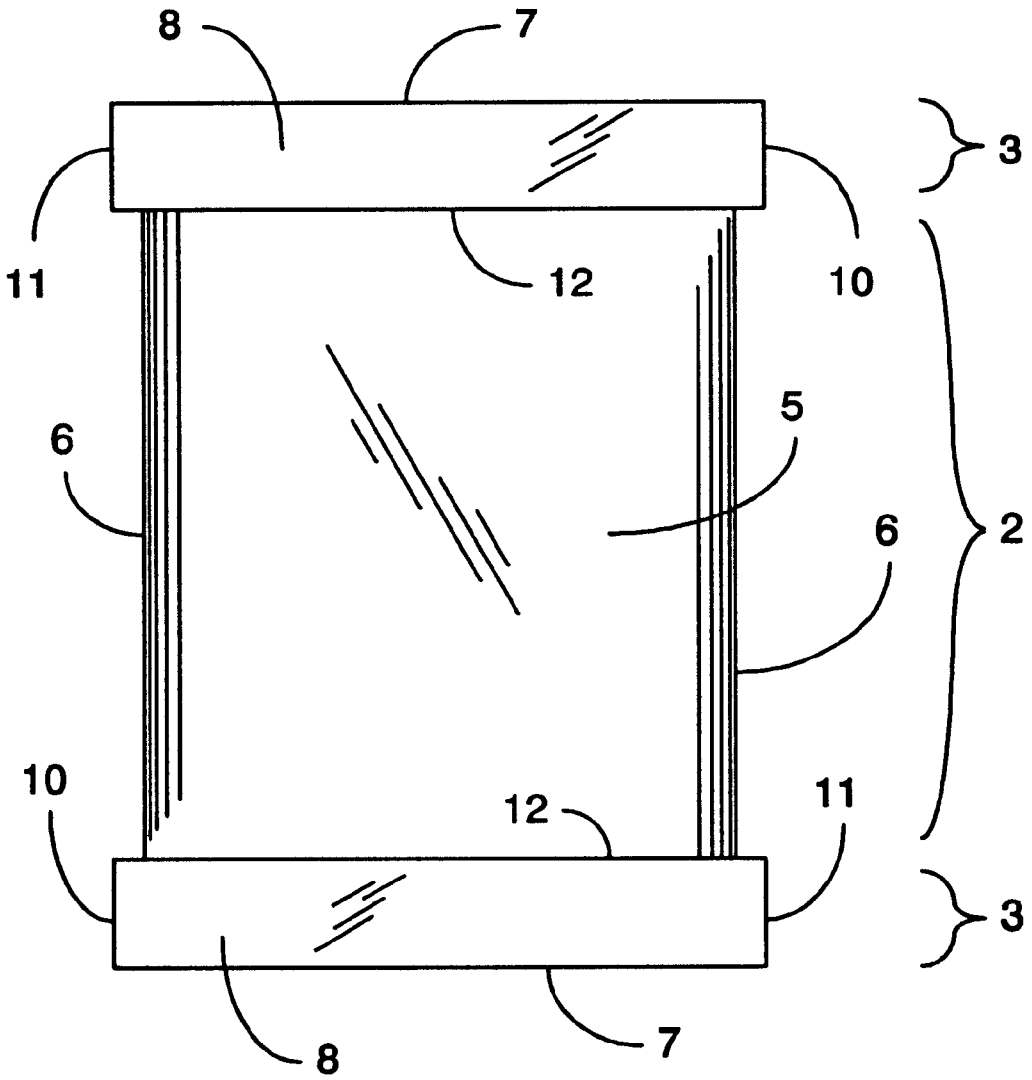
FIG. 3 is a top view of the preferred embodiment of FIG. 1 which illustrates the central window secured to the floating end walls.

FIG. 3 shows a top view of a preferred embodiment of the foldable underwater viewing window 1. This figure illustrates the foldable underwater viewing window 1 in the unfolded viewing configuration. In this configuration, the central viewing window 2 is inserted into the inner side walls 12 of floating end walls 3. Central viewing window 2 is shown with a transparent viewing area 5 and two side walls 6. Side walls 6 and central viewing area 5 are preferably made from a single piece of flexible transparent material, such as plastic, Mylar, polypropylene, polyethylene, etc. the side walls 6 curve upward from central viewing area 5. The upward curvature of side walls 6 in combination with the water tight seal created when central viewing window 2 is pressure fit into slot 4 creates a water barrier that allows central viewing area 5 to rest surface of the water without having any water spilling on top of the central viewing area 5. By having the central viewing area 5 below the water surface, the light refraction from the surface of the water is eliminated and the user can enjoy a clear view of the underwater environment.

Figure 4:
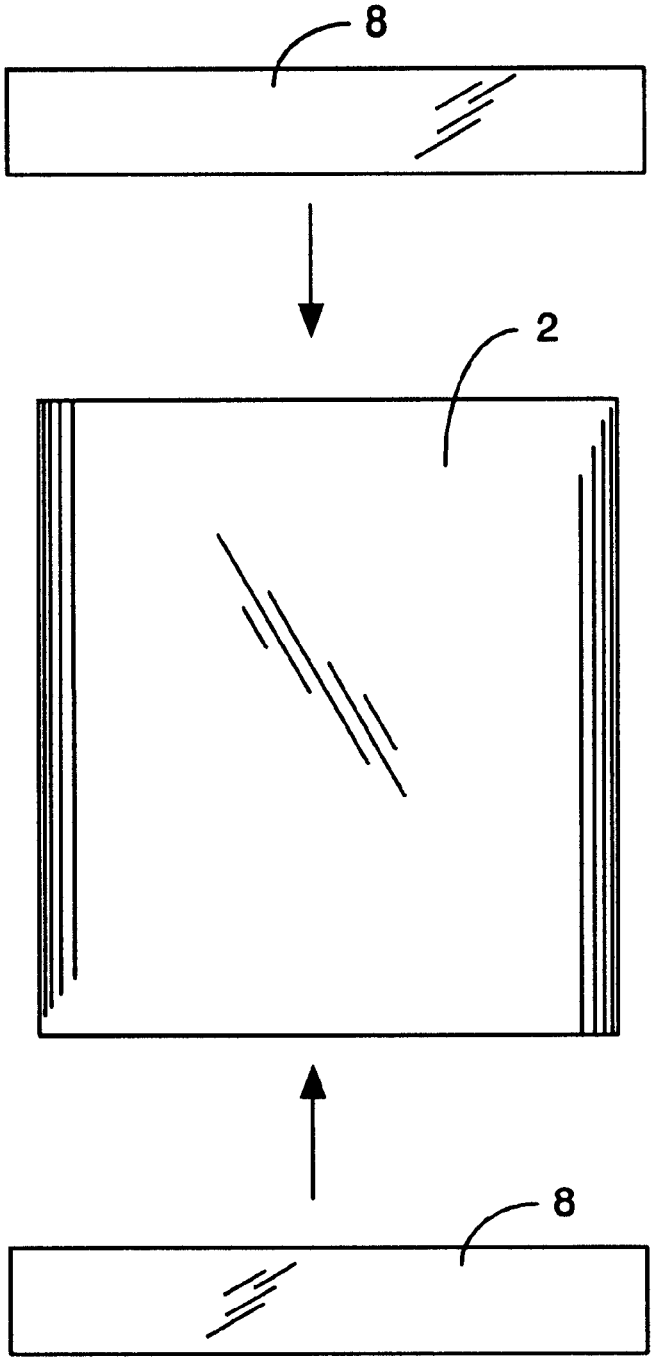
FIG. 4 is a top view of the preferred embodiment of FIG. 1 which shows an exploded view of the central window separated from the floating end walls.

FIG. 4 shows an exploded view of the embodiment of FIG. 3. As can be seen from this figure, a significant advantage of the invention is its simplicity of construction. The invention can be implemented from a single sheet of flexible transparent material (central viewing window 2) in combination with two buoyant end pieces (floating end walls 3). Central viewing window 2 can be any suitable transparent material, and floating end walls 3 can be any buoyant material capable of having a pressure fit slot 4 cut into it. This simplicity of construction allows the invention to be implemented very inexpensively. Also, that allows the user to assemble the foldable underwater viewing window 1 very rapidly and with a minimum amount of effort.

Figure 5:
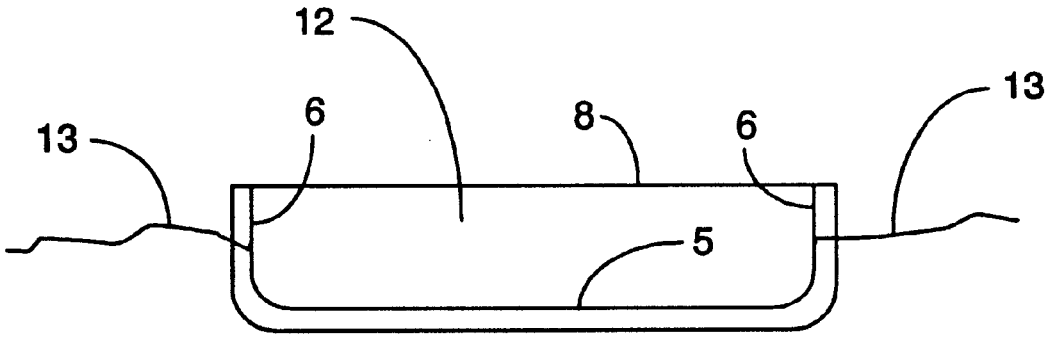
FIG. 5 is a cut away side view of the preferred embodiment of FIG. 1 which illustrates the central window installed in the floating end wall with the bottom surface of the central window below the surface of the water.

FIG. 5 is a cut away side view of a preferred embodiment of the invention in which an inner side surface 12 of floating end wall 3 is shown. In addition, the central viewing window 2 is installed and its central viewing area 5 is shown beneath the water surface 13. Also shown in this figure are side walls 6 which rise to from central viewing area 5 above the water surface 13. In the preferred embodiment, the aggregate weight of the foldable underwater viewing window 1 is designed to hold the central viewing area 5 below the water surface 13, but remain buoyant enough such that it does not sink below the water surface 13. In addition, the side walls 6 preferably have a length which is sufficient to extend the above the water such that the water is prevented from pouring over side walls 6 and resting on top of central viewing area 5.

Figure 6:
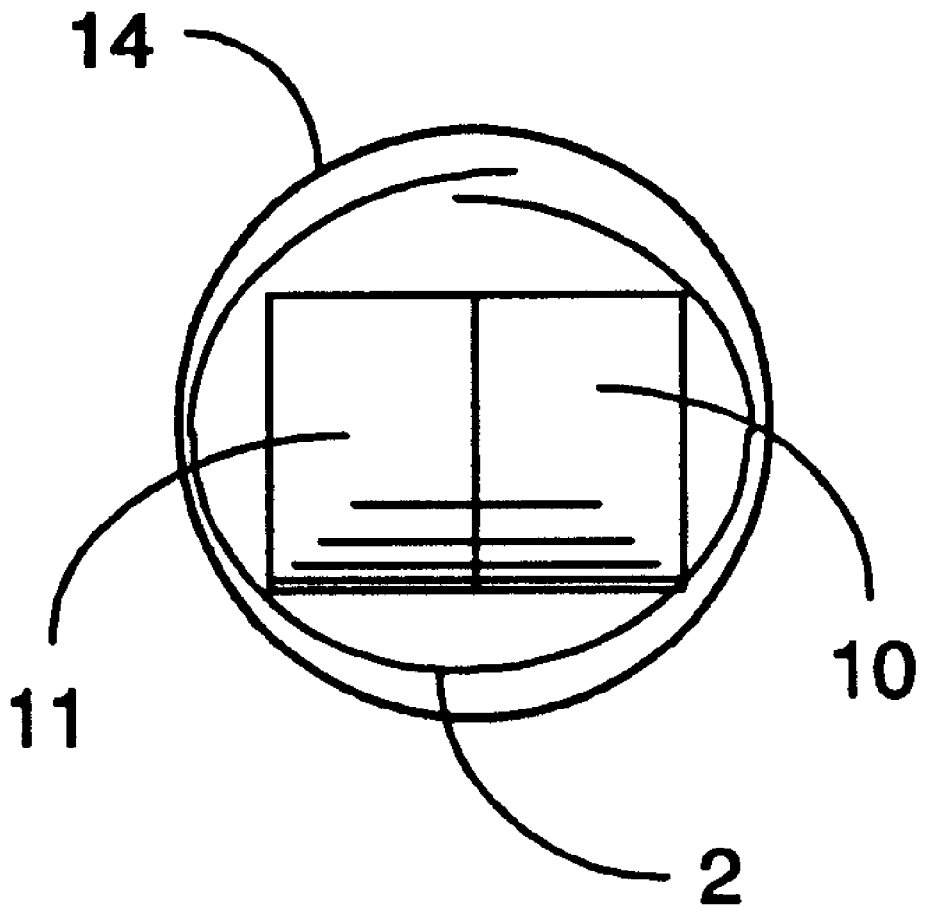
FIG. 6 is an end view of a preferred embodiment of FIG. 1 in which the floating side walls more wrapped inside the central window. The central window is shown secured in a folded configuration and held in place by an elastic strap.

FIG. 6 illustrates an end view of a preferred embodiment of the foldable underwater viewing window 1 in the storage configuration. In this configuration, the central viewing window 2 is separated from the floating end walls 6. The floating end walls 6 are placed adjacent to one another and the central viewing window 2 is rolled around the floating end walls 6. The central viewing window 2 may then be secured by an elastic strap, such as a commonly available rubber band. As shown in this figure, end walls 10, 11 of adjacent floating end walls 6 are wrapped in a compact storage configuration with central viewing window 2 wrapped securely around them. The ability to fold the foldable underwater viewing window 1 into a compact storage configuration such as this provides the user with the ability to conveniently transport and store the device. This is particularly useful for storage on boats which typically have limited storage space, and also on automobiles which may have limited storage space due to the many other items that the user may carry to the beach.

Figure 7:
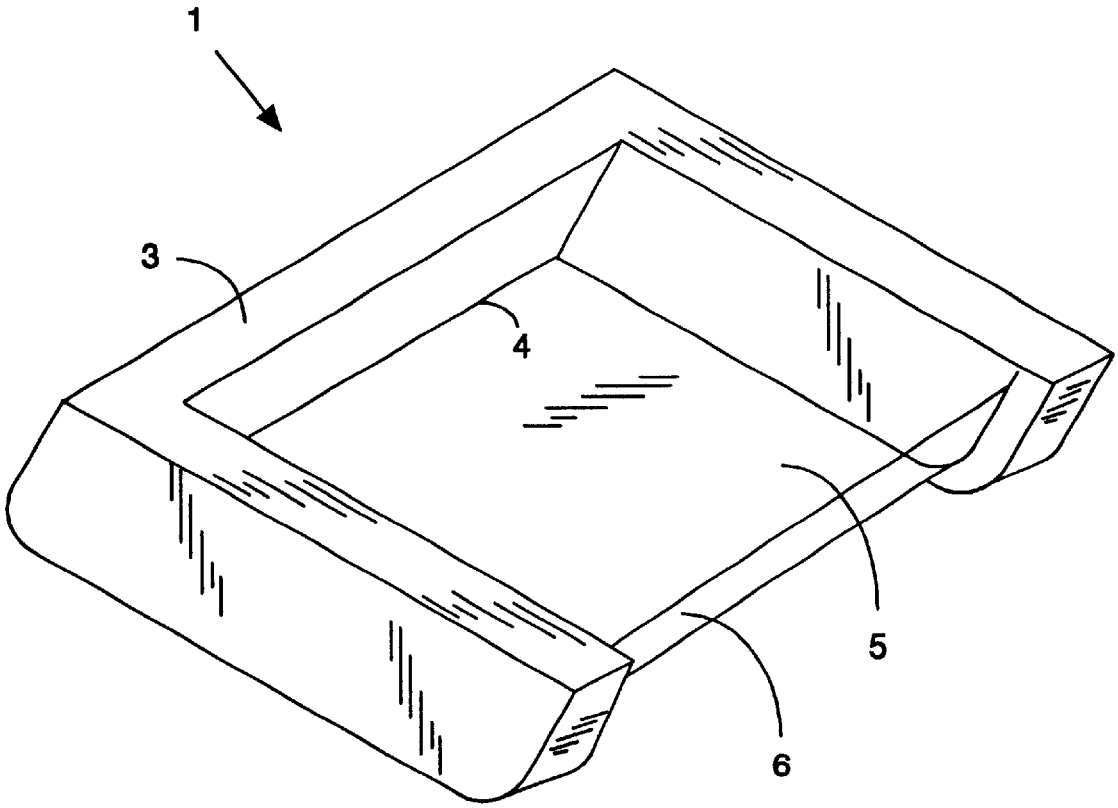
FIG. 7 is an alternative preferred embodiment which uses a single u-shaped floating end wall and a central window with a single side wall.

FIG. 7 is an alternative preferred embodiment which uses a single u-shaped floating end wall 3 and a central window 2 which has a single side wall 6 and a central viewing area 5. In this embodiment, in order to fold the floating underwater viewing window 1 into the storage configuration, the material used to fabricate the floating end wall 3 should preferably be flexible enough to allow the end portions of the floating end wall 3 to fold flap against central portion. Likewise, a single peripheral floating end wall 3 can be used to attach to a flat central viewing window 2 providing that the floating end wall 3 is sufficiently flexible to be stretched for insertion of the central viewing window 2 into the slot 4.

Those skilled in the art will recognize that the central viewing window 2 can be constructed from rigid material. However, while the floating end walls 3 could still be attached, the storage configuration would most likely take more space than what the required when using a flexible central viewing window 2.

While the invention has been described with respect to a preferred embodiment thereof it will be understood by those skilled in the art that various changes in detail may be made therein without departing from the spirit, scope, and teaching of the invention. For example, the material used to construct the floating end walls or the central viewing window may be anything suitable for their intended purpose, the size and shape of the device may vary, etc. Accordingly, the invention herein disclosed is to be limited only as specified in the following claims.

I claim:

1. A foldable underwater viewing window, comprising:

a central viewing window;

at least one floating outer wall;

the central viewing window secured to the floating outer wall such that a water tight seal is made between the central viewing window and the floating outer wall; and the central viewing window further having a transparent central viewing area that extends below the surface of water such that light refraction from the surface of the water is eliminated;

whereby the aquatic environment underneath the surface of the water can be clearly viewed without interference from light refraction on the surface of the water.

2. A foldable underwater viewing window, as in claim 1, wherein the central viewing window is flexible.

3. A foldable underwater viewing window, as in claim 2, wherein:

the central viewing window is detachably attached to the floating end wall; and means to secure the central viewing window to the floating end wall when the central viewing window is detached from the floating end wall such that the central viewing window and the floating end wall are secured in a storage configuration;

whereby the foldable underwater viewing window has an unfolded viewing configuration and a foldable storage configuration.

4. A foldable underwater viewing window, as in claim 3, wherein the weight of the foldable underwater viewing window is selected such that the foldable underwater viewing window is sufficiently buoyant to float on the surface of water and sufficiently heavy that the viewing window is below the surface of the water when the foldable underwater viewing window is floating on the surface of the water.

5. A foldable underwater viewing window, as in claim 4, further comprising:

a slot in the floating end wall, the slot sized such that when the central viewing window is inserted into it the central viewing window is secured to the floating end wall with a pressure fit that is sufficiently tight to substantially prevent water from leaking onto the upper surface of the central viewing window.

6. A foldable underwater viewing window, as in claim 1, wherein the central viewing window is secured to two floating end walls, each end wall attached to an opposing side of the central viewing window.

7. A foldable underwater viewing window, as in claim 6, wherein:

the central viewing window is flexible;

the central viewing window is flex to such that when attached to the two floating end walls, a central viewing area is formed and two upwardly projecting side walls are formed.

8. A foldable underwater viewing window, as in claim 7, wherein the weight of the foldable underwater viewing window is selected such that the foldable underwater viewing window is sufficiently buoyant to float on the surface of water and sufficiently heavy that the viewing window is below the surface of the water when the foldable underwater viewing window is floating on the surface of the water.

9. A foldable underwater viewing window, as in claim 8, wherein:

the central viewing window is detachably attached to the floating end wall; and means to secure the central viewing window to the floating end wall when the central viewing window is detached from the floating end wall such that the central viewing window and the floating end wall are secured in a storage configuration;

whereby the foldable underwater viewing window has an unfolded viewing configuration and a foldable storage configuration.

10. A foldable underwater viewing window, as in claim 9, further comprising:

a slot in the floating end wall, the slot sized such that when the central viewing window is inserted into it the central viewing window is secured to the floating end wall with a pressure fit that is sufficiently tight to substantially prevent water from leaking onto the upper surface of the central viewing window.

11. A method of viewing underwater environments with a floating surface window, including the steps of:

attaching a central viewing window to at least one floating outer wall;

securing the central viewing window to the floating outer wall such that a water tight seal is made between the central viewing window and the floating outer wall;

positioning the central viewing window below the surface of water such that light refraction from the surface of the water is eliminated; and using a flexible transparent panel for the central viewing window;

whereby the aquatic environment underneath the surface of the water can be clearly viewed without interference from light refraction on the surface of the water.

12. A method, as in claim 11, including the additional steps of:

detachably attaching the central viewing window to the floating end wall; and securing the central viewing window to the floating end wall when the central viewing window is detached from the floating end wall such that the central viewing window and the floating end wall are secured in a storage configuration;

whereby the foldable underwater viewing window has an unfolded viewing configuration and a foldable storage configuration.

13. A method, as in claim 12, including the additional step of selecting the weight of the foldable underwater viewing window such that the foldable underwater viewing window is sufficiently buoyant to float on the surface of water and sufficiently heavy that the viewing window is below the surface of the water when the foldable underwater viewing window is floating on the surface of the water.

14. A method, as in claim 13, including the additional step of forming a slot in the floating end wall, the slot sized such that when the central viewing window is inserted into it the central viewing window is secured to the floating end wall with a pressure fit that is sufficiently tight to substantially prevent water from leaking onto the upper surface of the central viewing window.

15. A method of viewing underwater environments with a floating surface window, including the steps of:

using two floating end walls;

attaching a central viewing window to the two floating end walls such that the two floating end walls are attached to opposing sides of the central viewing window;

securing the central viewing window to the floating end walls such that a water tight seal is made between the central viewing window and the floating end walls; and positioning the central viewing window below the surface of water such that light refraction from the surface of the water is eliminated;

whereby the aquatic environment underneath the surface of the water can be clearly viewed without interference from light refraction on the surface of the water.

16. A method, as in claim 15, including the additional steps of:

forming the central viewing window with a flexible transparent panel; and attaching the two floating end walls to the central viewing window such that a central viewing area is formed and two upwardly projecting side walls are formed.

17. A method, as in claim 16, including the additional step of selecting the weight of the foldable underwater viewing window such that the foldable underwater viewing window is sufficiently buoyant to float on the surface of water and sufficiently heavy that the viewing window is held below the surface of the water when the foldable underwater viewing window is floating on the surface of the water.

18. A method, as in claim 17, including the additional steps of:

detachably attaching the central viewing window to the floating end wall; and securing the central viewing window to the floating end wall when the central viewing window is detached from the floating end wall such that the central viewing window and the floating end wall are secured in a storage configuration;

whereby the foldable underwater viewing window has an unfolded viewing configuration and a foldable storage configuration.

19. A method of, as in claim 18, including the additional step of forming a slot in the floating end wall the slot sized such that when the central viewing window is inserted into it, the central viewing window is secured to the floating end wall with a pressure fit that is sufficiently tight to substantially prevent water from leaking onto the upper surface of the central viewing window.

* * * * *